US010561183B1

(12) United States Patent
Conard

(10) Patent No.: US 10,561,183 B1
(45) Date of Patent: Feb. 18, 2020

(54) METHOD AND APPARATUS FOR CREATING AN IMAGE ON A FABRIC

(71) Applicant: Adam Conard, Denver, CO (US)

(72) Inventor: Adam Conard, Denver, CO (US)

( * ) Notice: Subject to any disclaimer, the term of this patent is extended or adjusted under 35 U.S.C. 154(b) by 0 days.

(21) Appl. No.: 16/431,083

(22) Filed: Jun. 4, 2019

Related U.S. Application Data

(63) Continuation-in-part of application No. 13/972,458, filed on Aug. 21, 2013, now Pat. No. 10,309,055.

(51) Int. Cl.

| | |
|---|---|
| ***A41D 31/02*** | (2019.01) |
| ***D06P 5/00*** | (2006.01) |
| ***A41D 1/04*** | (2006.01) |
| ***D06P 5/28*** | (2006.01) |

(52) U.S. Cl.
CPC ..... *A41D 31/02* (2013.01); *A41D 1/04* (2013.01); *D06P 5/004* (2013.01)

(58) Field of Classification Search
CPC ..... A41D 31/02; A41D 1/04; D06P 5/004
See application file for complete search history.

(56) References Cited

U.S. PATENT DOCUMENTS

2008/0201824 A1* 8/2008 Kronenberger ..... A42B 1/248 2/195.1

* cited by examiner

*Primary Examiner* — Amina S Khan
(74) *Attorney, Agent, or Firm* — Richard Eldredge

(57) ABSTRACT

A method and apparatus for creating an image on a fabric includes creating a first layer of fabric having an image printed in a first color and a background printed in a second color; creating shapes printed over a top of the image, the shapes being the second color; creating a second layer of fabric having openings extending therethrough; aligning the second layer over a top of the first layer such that the shapes are positioned underneath the openings; and shifting the first layer relative to the second layer such that the image at least partially shows through the openings due to the shifting of the openings away from the shapes.

10 Claims, 8 Drawing Sheets

METHOD AND APPARATUS FOR CREATING AN IMAGE ON A FABRIC

BACKGROUND

1. Field of the Invention

The present invention relates generally to fabrics and textiles, and more specifically, to a system and method for creating an image on a fabric, particularly when the fabric is stretched or otherwise shifted.

2. Description of Related Art

Garment and jersey manufactures are always looking for new and exciting ways to improve the look and performance of their products. For instance, compression garments have become very popular. These garments are form fitting and use synthetic fabrics that have elastic properties. These fabrics tend to wick away perspiration and tend to help cool athletes when they are hot and warm them if they are cool. However, advertisements and emblems on these garments tend to be flat, subtle and mundane, which limits the revenue from advertisers and excitement for the fans. Thus, there exists a need for method of creating fabrics that are dynamic and flashy.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
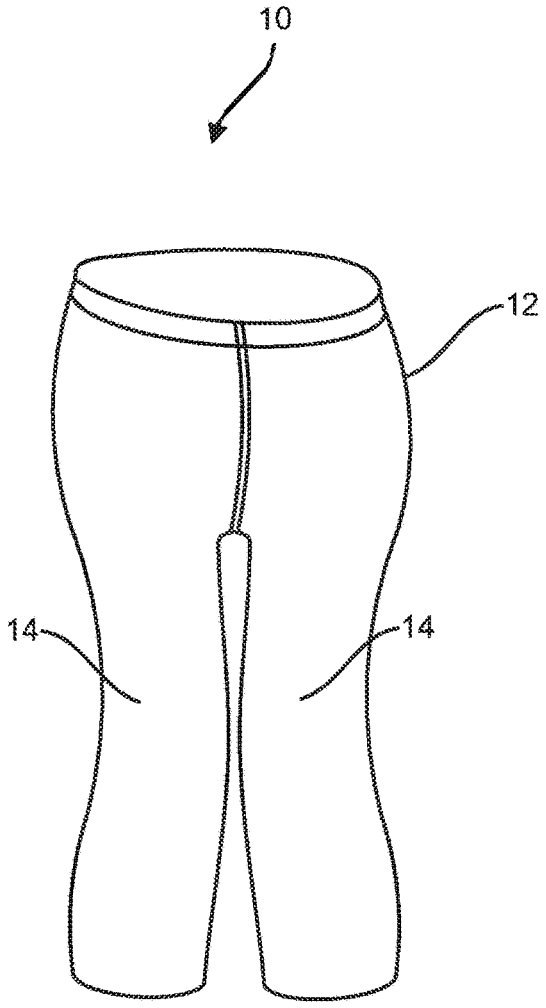
FIG. 1 is a simplified front view of a garment in accordance with one embodiment of the invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
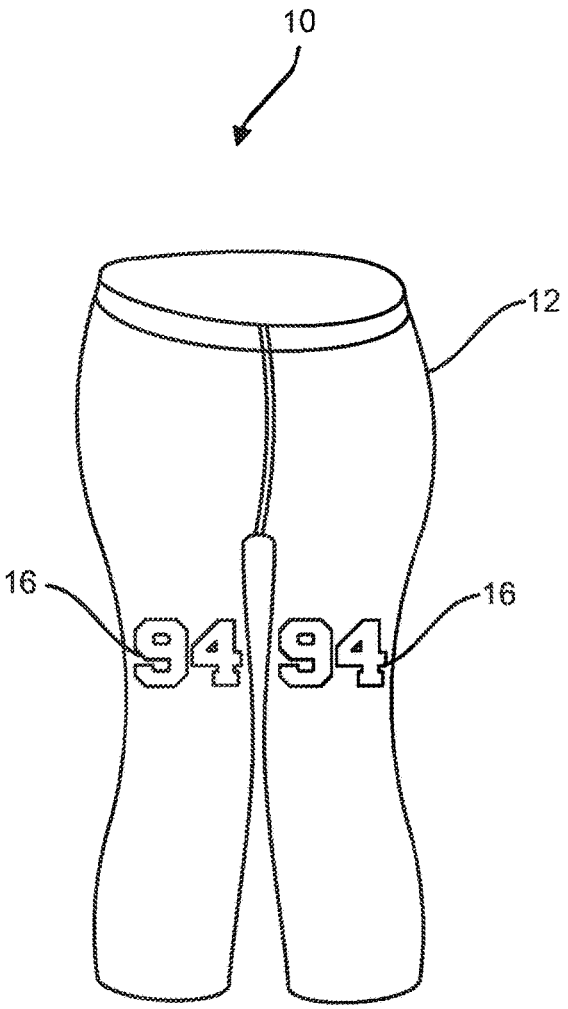
FIG. 2 is a front view of the garment in accordance with one embodiment of the present application.

Referring now to the drawings wherein like reference characters identify corresponding or similar elements throughout the several views. FIG. 1 is a cartoon drawing of a garment 10 in accordance with one embodiment of the invention. In this example the garment is a pair of football pants 12. The pants are either made of stretch fabric or at least the knee portion 14 of the pants 12 are made of stretch fabric with an image created thereon. FIG. 2 is a cartoon drawing of a garment 10 in accordance with one embodiment of the invention. In this figure the fabric in the knee 14 is stretched and the image 16 is now visible. In this case the image is the player's number, but any image can be created. The image is dynamic because it is visible when the fabric is stretched, but not visible when the fabric is in a relaxed state. The size and the brightness of the image varies depending on how much the fabric is stretched, making a flashy image.

Figure 3:
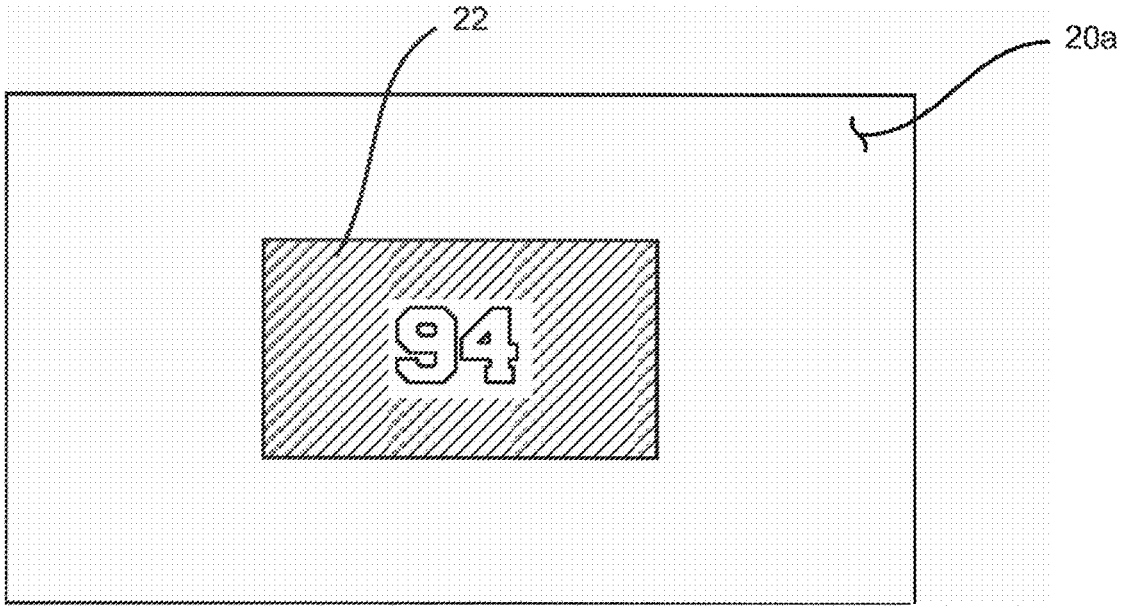
FIG. 3 is a fabric with a first image in accordance with one embodiment of the present invention.

FIG. 3 is a fabric 20*a* with a first image in accordance with one embodiment of the invention. The fabric 20*a* is a stretch fabric that may be a two way or a four way stretch fabric. However, the four way stretch fabric is generally preferred for most applications. For best result, the fabric's original color is very bright, such as a neon color although this will also work on white or light colored fabrics. The fabric 20*a* has a first side 20*a* and a second side 20*b*. In one embodiment, the back side 20*a* is dyed with a knock out image 22 although other images than knock out images may be used. Note the number 94 is not dyed. For best results a sublimation dye process is used to make the image. Sublimation dying may be a direct printing process or may be an indirect process using transfer paper as is well understood in the art.

Figure 4:
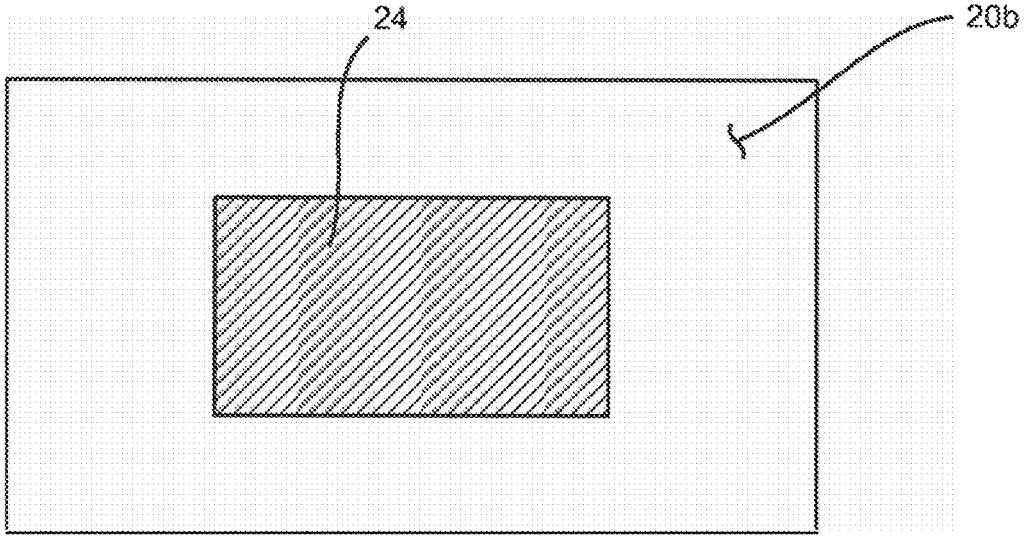
FIG. 4 is a fabric with a second image in accordance with one embodiment of the invention.

FIG. 4 is the fabric 20*b* with a second image 24 in accordance with one embodiment of the invention. The second image is printed on the front side 20*b* of the fabric 20. The dye color is darker than the fabric color and in one embodiment is the same color as the dye used to make the knock out image 22.

In another embodiment, the knock out image 22 is placed on a first fabric 20*a* and the cover 24 is placed on a second fabric 20*b*. The two pieces 20 *a*, 20*b* of fabric are held together so the images overlap with the first fabric 20*a* on the outside. When the fabrics are stretched the knock out image 22 is visible. For the best results the second fabric 20*b* is a light colored fabric.

Note in one embodiment, the image 22 may be something other than a knock out image.

Figure 5:
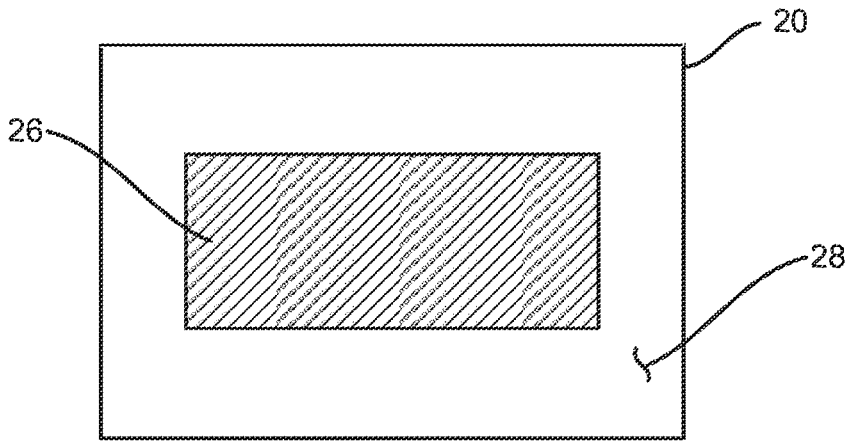
FIG. 5 is a front view of a stretch fabric in a relaxed state in accordance with one embodiment of the invention.
Figure 6:
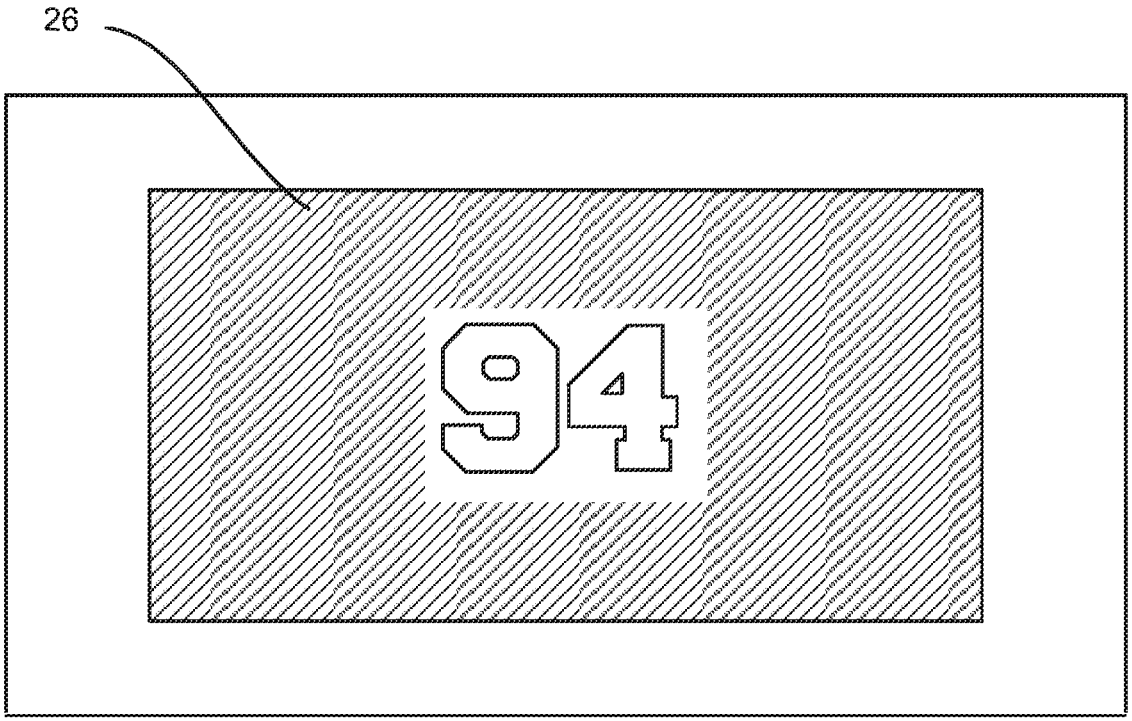
FIG. 6 is a front view of a stretch fabric in a stretched state in accordance with one embodiment of the invention.

FIG. 5 is a front view of a stretch fabric 20 in a relaxed state in accordance with one embodiment of the invention after it has been dyed as explained with respect to FIGS. 3 & 4. The image 26 just looks like a dark square on the fabric 20. Note that the image may be a circle, oval or almost any shape. In one embodiment all of the fabric is dyed so there is no un-dyed portion 28. FIG. 6 is a front view of a stretch fabric in a stretched state in accordance with one embodiment of the invention. Now the image 26 shows the number 94. The number 94 will have the same color (or similar color) as the original fabric.

Figure 7:
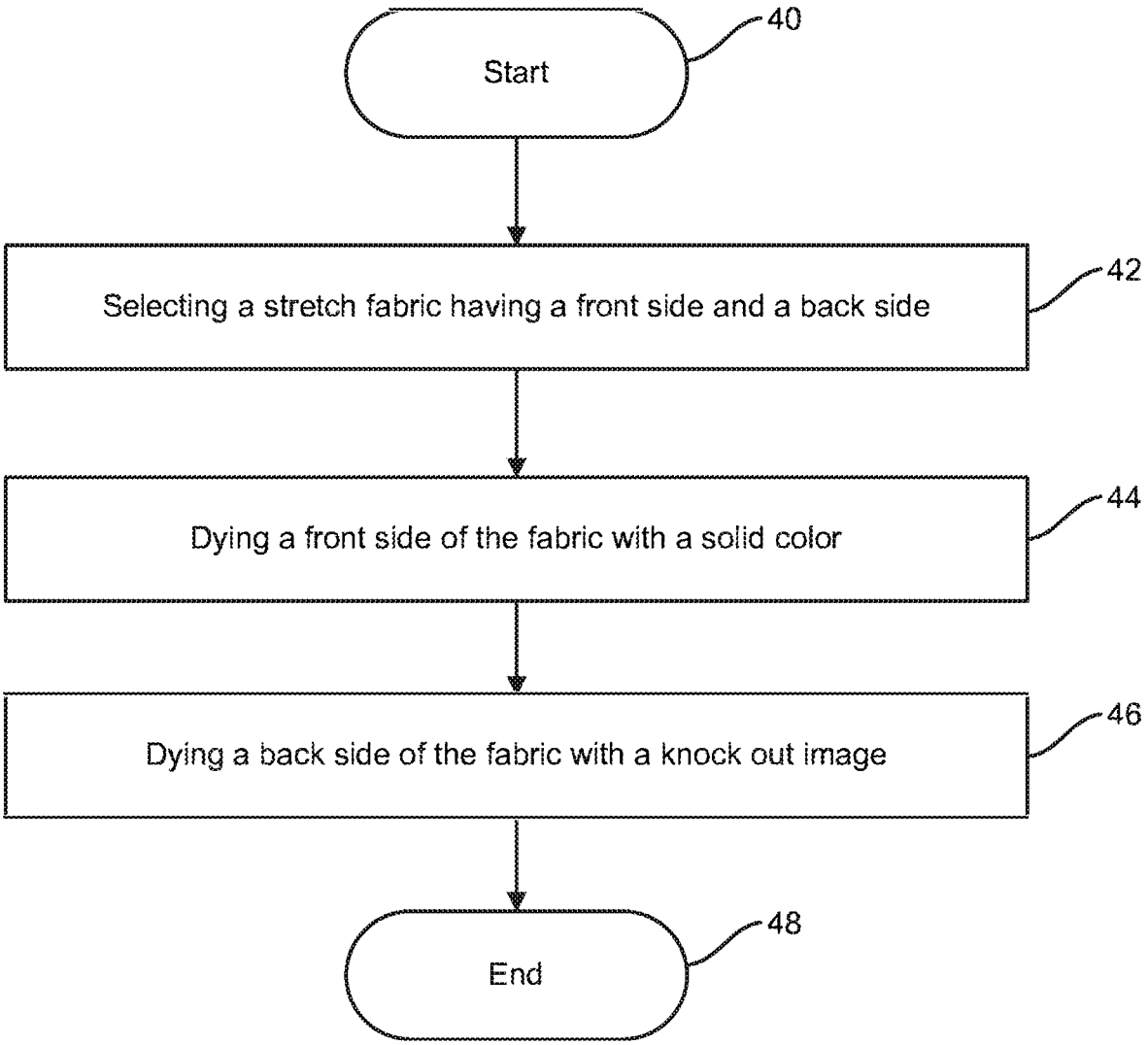
FIG. 7 is a flow chart of the steps used in the method of creating an image on a stretch fabric in accordance with one embodiment of the invention.
Figure 8A:
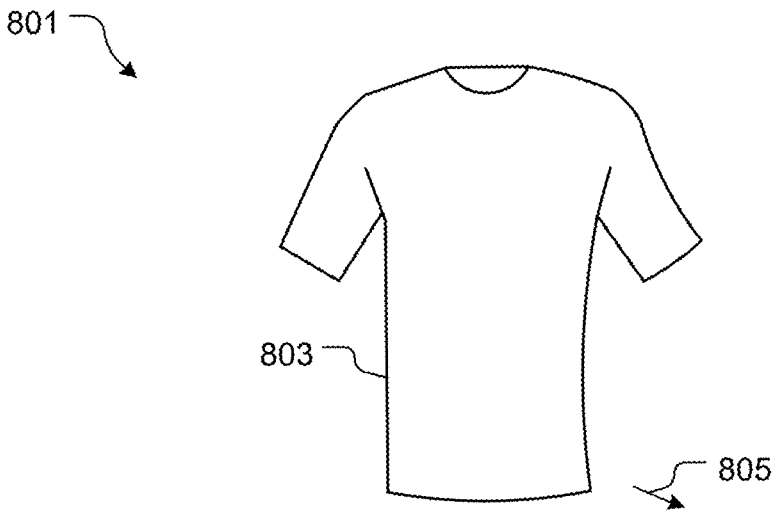
FIGS. 8A and 8B demonstrate a shirt composed wholly or partially of any of the fabrics of the present invention in a relaxed and stretched state.
Figure 8B:
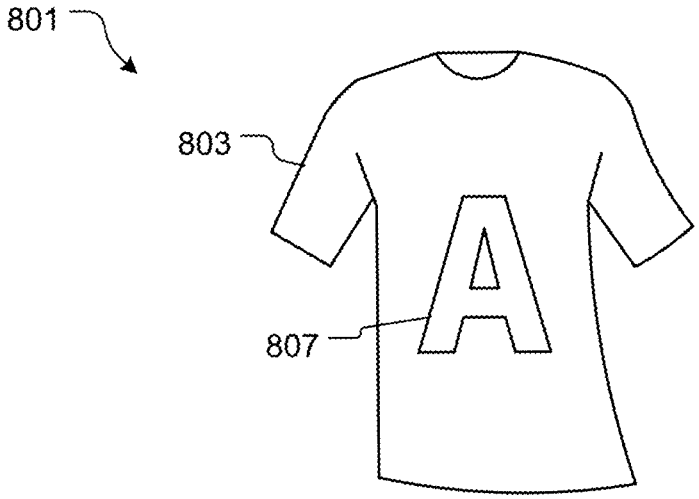

FIG. 7 is a flow chart of the step used in a method of creating an image on a stretch fabric in accordance with one embodiment of the invention. The process starts, step 40, by selecting a stretch fabric have a front side and a back side at step 42. The front side of the fabric is dyed with a solid color at step 44. At step 46, a back side of the fabric is dyed with a knock out image, which ends the process at step 48. The order of when the images are dyed in not important in this embodiment.

Without being held to any particular theory the invention is believed to work because just the surface fibers of the stretch fabric are dyed. When the fabric is stretched part of the fibers are now exposed that were not dyed. Thus, by dying the front and back with a darker color except where the knock out image is results in the only un-dyed fibers are those in the knock out image. Note this effect can also be achieved by first placing the knock out image on the front of the fabric and then dying a filled in image over the top of the knock out image, but it is not the preferred method. If this theory is correct the key points to the invention are just coloring the surface fibers in the relaxed state and coloring them with something that does not inhibit the stretching of the fabric/fibers.

Thus, there has been described a method of creating fabrics that which is dynamic and flashy.

In FIGS. 8-13, an alternative embodiment of an apparatus and method of creating an image on fabric is shown. In FIGS. 8A and 8B, an article of clothing 801 is shown composed in whole or in part of a fabric 803 in accordance with the present invention. As shown, as the fabric 803 is stretched 805, an image 807 is created due to the features discussed herein. It should be appreciated that the fabric need not be stretched a great deal but must be shifted at least slightly to display the image 807. It should be appreciated that the system could also be used to create a second coloration appearance to fabric and/or a pattern associated with the fabric.

Figure 9:
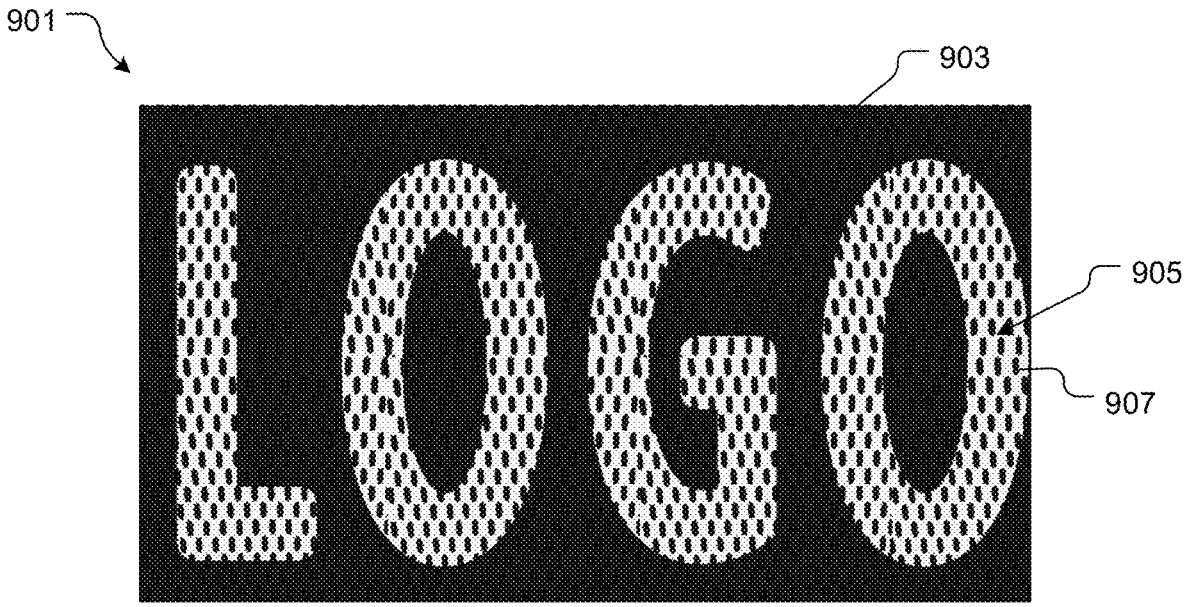
FIG. 9 is an illustration of a first layer of fabric in accordance with an alternative embodiment of the present application.
Figure 10:
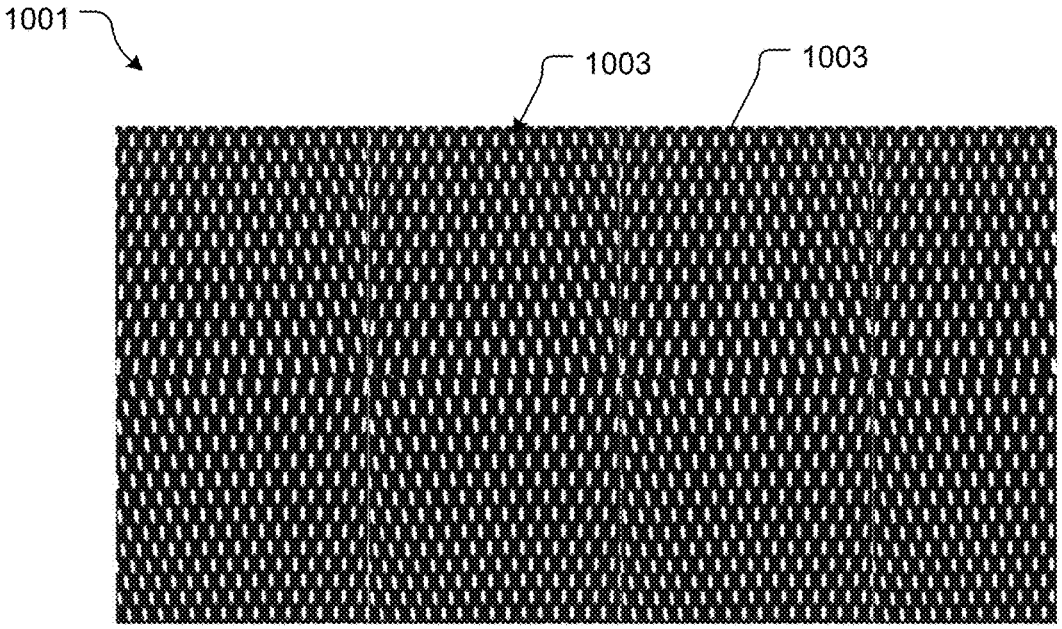
FIG. 10 is an illustration of a second layer of fabric in accordance with the alternative embodiment of the present application.

In FIGS. 9 and 10, a first layer 901 and a second layer 1001 are shown and contemplated for use with the present invention. First layer 901 is composed of a suitable fabric 903, such as a stretch fabric, and includes an image 905 printed thereon. As shown, the image 905 is a first color while the rest of the fabric is a second color dissimilar from the first. The first layer 901 further includes a plurality of shapes 907 printed on top of the image, the shapes 907 being the same color as the background color of the fabric. It should be appreciated that the plurality of shapes 907 can be round, rectangular, or any other shape as desired based on aesthetical, functional, or manufacturing considerations. It should be appreciated that bright colors can be suitable for the present invention to create a brighter image.

As shown in FIG. 10, the second layer 1001 is composed of fabric 1003 that is similar to a mesh material, including a plurality of openings 1005 extending through a thickness of the fabric 1003. The second layer 1001 is the same color as the plurality of shapes 907 and the background color of the first layer. In the preferred embodiment, the plurality of openings is slightly smaller than the plurality of shapes, and are configured to align with the plurality of shapes.

Figure 11:
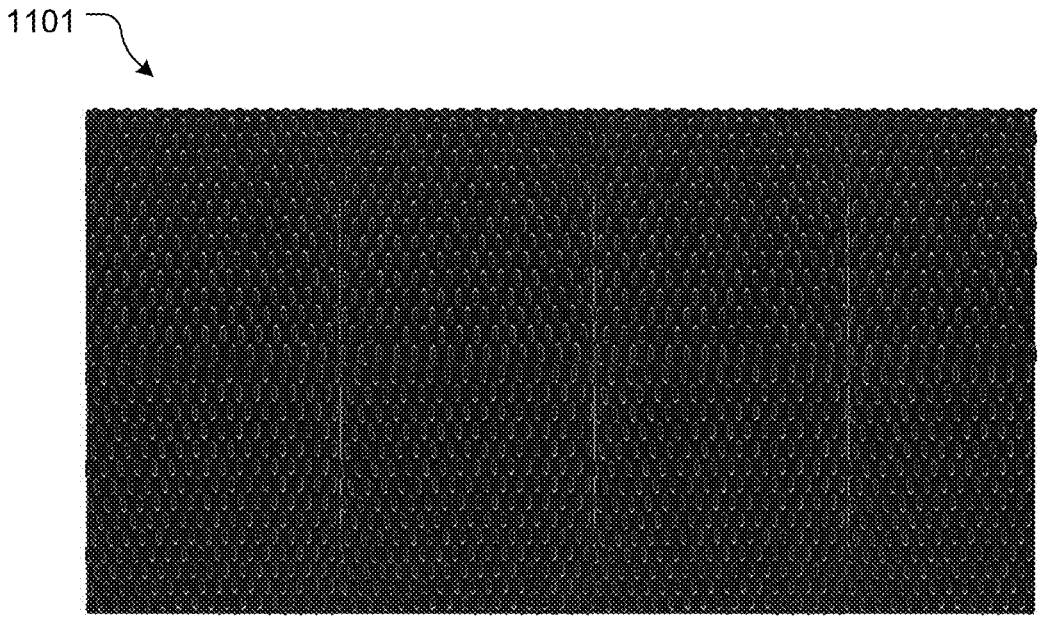
FIG. 11 is an illustration of the second layer of FIG. 10 positioned on top of the first layer of FIG. 9.
Figure 12:
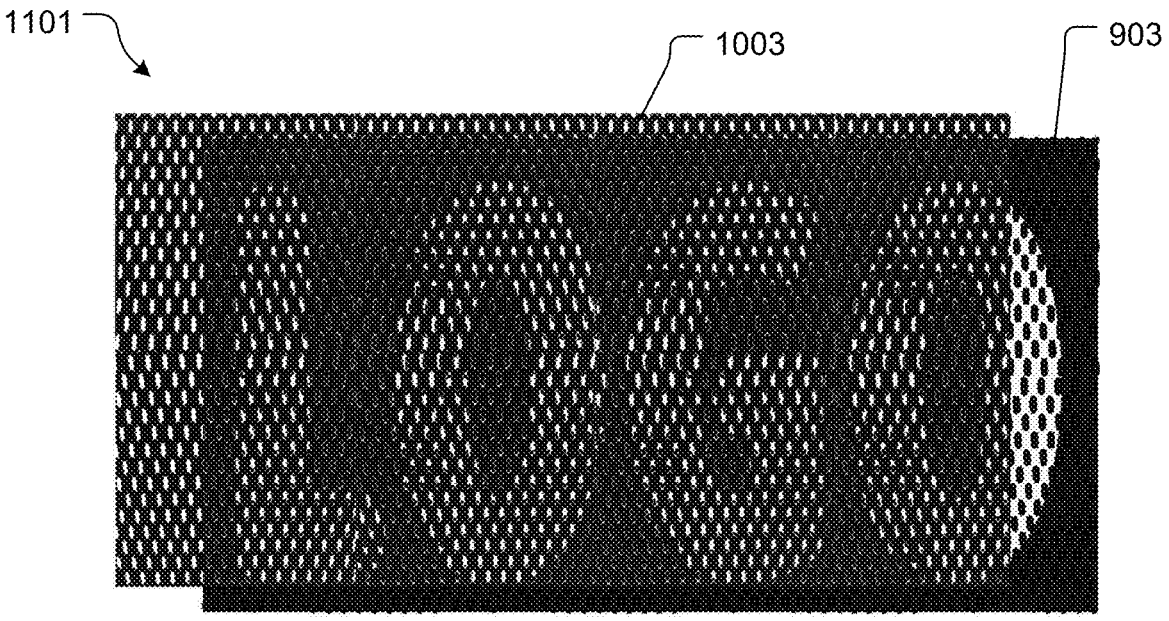
FIG. 12 is an illustration of the fabric of FIG. 11 in a stretched configuration.

As shown in FIG. 11, the second layer 1001 is secured over the top of the first layer 901, thereby creating an apparatus 1101 that can be used as desired by the user, such as with clothing article 801. As shown, the plurality of openings 1005 align with the plurality of shapes, thereby giving the appearance of a solid colored apparatus. As shown in FIG. 12, as the apparatus 1101 is shifted, such as by stretching, movement, or the like, the top layer will slightly shift in place, thereby providing visibility through the plurality of openings. As this occurs, the image 905 will become at least partially visible through the plurality of openings.

It should be appreciated that apparatus 1101 can be incorporated into clothing, such that when the user shifts and moves, the image will show through the plurality of openings.

Figure 13:
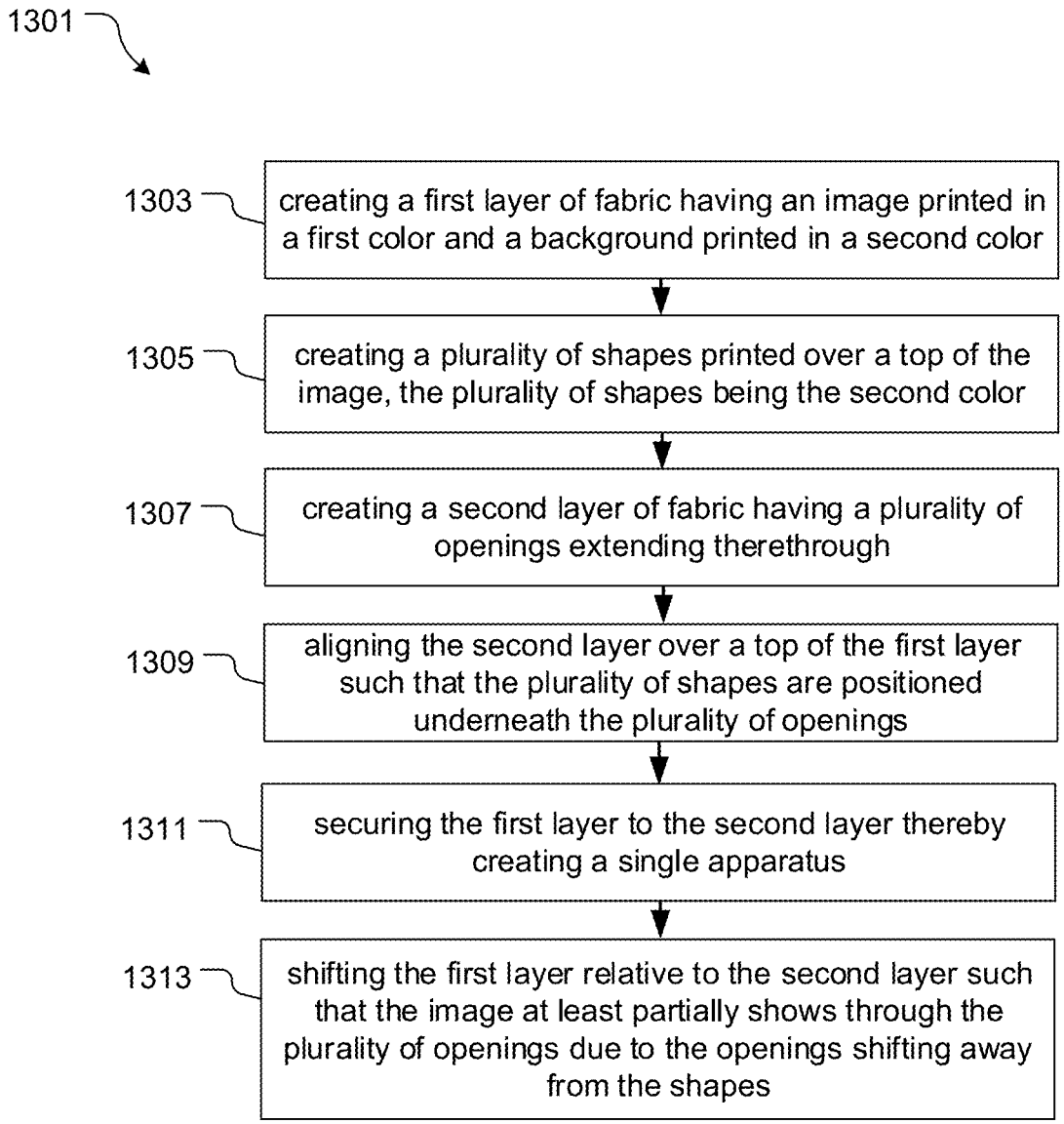
FIG. 13 is a flowchart of the method of creating an image on fabric associated with the alternative embodiment.

In FIG. 13, a flowchart depicts the method of creating apparatus 1101. The first layer is created having an image printed in a first color and a background printed or dyed in a second color, as shown with box 1303. It should be appreciated that this step could be achieved via printing, dying, or otherwise creating the fabric as is known in the art. The first layer further receives a plurality of shapes over the top of the image, again via any known or future developed means, the plurality of shapes being the same as the background color of the first layer, as shown with box 1305. The second layer is then created having a plurality of openings extending therethrough, as shown with box 1307. In the preferred embodiment, the openings are slightly smaller than the plurality of shapes. It should be appreciated that the creation of the openings can be through any means, such as dye cutting or using a CNC machine. The second layer being the same color as the background and plurality of shapes of the first layer. The second layer is then aligned with the first layer, such that the plurality of openings and the plurality of shapes align, as shown with box 1309. The first layer and second layer can be secured together, such as through sewing, as shown with box 1311. The created apparatus can then be shifted, stretched, or otherwise altered, such that the second layer shifts out of place slightly, revealing the image through the plurality of openings, as shown with box 1313.

It must be appreciated and understood that the image can be a logo, a shape, or the like. Further, it should be appreciated and understood that the teachings of the various embodiments discussed herein can be interchanged based on the desires and needs of the user and manufacturer.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A method for creating an image on a fabric, the method comprising:

creating a first layer of fabric having an image printed in a first color and a background printed in a second color;

creating a plurality of shapes printed over a top of the image, the plurality of shapes being the second color;

creating a second layer of fabric having a plurality of openings extending therethrough;

aligning the second layer over a top of the first layer such that the plurality of shapes are positioned underneath the plurality of openings; and shifting the first layer relative to the second layer such that the image at least partially shows through the plurality of openings due to the openings shifting away from the shapes.

2. The method of claim 1, further comprising:

securing the first layer to the second layer thereby creating a single apparatus.

3. The method of claim 2, further comprising:

incorporating the single apparatus into an article of clothing.

4. The method of claim 1, wherein the plurality of shapes are larger than the plurality of openings.

5. The method of claim 1, wherein the second layer is the second color.

6. The method of claim 1, wherein the creating the second layer comprises:

dye cutting the second layer to create the plurality of openings.

7. The method of claim 1, wherein the creating the second layer comprises:

using a CNC machine to create the plurality of openings.

8. An apparatus for creating an image on a fabric, the apparatus comprising:

a first layer of fabric having an image printed in a first color and a background printed in a second color, the first layer further having a plurality of shapes printed on top of the image and in the second color;

a second layer of fabric having a plurality of openings extending therethrough, the second layer of fabric positioned over the top layer of fabric such that the plurality of openings align with the plurality of shapes;

wherein shifting of the second layer relative to the first layer reveals at least part of the image through the plurality of openings.

9. The apparatus of claim 8, wherein the second layer is the second color.

10. The apparatus of claim 8, wherein the plurality of shapes are larger than the plurality of openings.

* * * * *